US010369405B2

(12) United States Patent
Zhu

(10) Patent No.: US 10,369,405 B2
(45) Date of Patent: Aug. 6, 2019

(54) LOW ENERGY CONSUMPTION, HIGH EFFICIENCY TREADMILL

(71) Applicant: ZHE JIANG FENG SHANG TECHONOLOGY CO., LTD., Hangzhou (CN)

(72) Inventor: Zhengyuan Zhu, Hangzhou (CN)

(73) Assignee: ZHE JIANG FENG SHANG TECHNOLOGY CO., LTD., Hangzhou (CN)

( * ) Notice: Subject to any disclaimer, the term of this patent is extended or adjusted under 35 U.S.C. 154(b) by 0 days.

(21) Appl. No.: 15/551,025

(22) PCT Filed: Apr. 12, 2016

(86) PCT No.: PCT/CN2016/079101

§ 371 (c)(1),
(2) Date: Aug. 14, 2017

(87) PCT Pub. No.: WO2016/127958

PCT Pub. Date: Aug. 18, 2016

(65) Prior Publication Data

US 2018/0178056 A1 Jun. 28, 2018

(30) Foreign Application Priority Data

Feb. 12, 2015 (CN) ..... 2015 1 0075120

(51) Int. Cl.
*A63B 22/02* (2006.01)
*A63B 71/00* (2006.01)

(52) U.S. Cl.
CPC ..... *A63B 22/0235* (2013.01); *A63B 22/0214* (2015.10); *A63B 22/0221* (2015.10); *A63B 2071/0063* (2013.01)

(58) Field of Classification Search
CPC ..... A63B 22/02
See application file for complete search history.

(56) References Cited

U.S. PATENT DOCUMENTS 5,141,479 A * 8/1992 Vanjani ..... A63B 22/02 482/54
5,674,453 A * 10/1997 Watterson ..... A63B 22/0012 482/54

(Continued)

FOREIGN PATENT DOCUMENTS

CN 101931292 12/2010
CN 203790512 8/2014

(Continued)

OTHER PUBLICATIONS

International Search Report and Written Opinion, issued in the corresponding PCT application No. PCT/CN2016/079101, dated Jul. 19, 2016, 18 pages.

(Continued)

*Primary Examiner* — Stephen R Crow
(74) *Attorney, Agent, or Firm* — Hamre, Schumann, Mueller & Larson, P.C.

(57) ABSTRACT

This invention belongs to technical field of the treadmill, especially, it is a kind of kind of low-energy consumption high-efficient treadmill. It solved some technical issues such that the machine adopting existing technology has large noise, and the operation can consume a lot of energy and so on. The low-energy consumption high-efficient treadmill includes the treadmill rack, and the treadmill rack is set with annular running belt, one end of the treadmill rack is equipped with the rotation roller, and the other end is set with the outer rotor brushless DC motor, the rotation roller mentioned above are arranged with the outer rotor brushless DC motor in parallel, the annular running belt mentioned above is winded between rotation roller and outer rotor brushless DC motor, and outer rotor brushless DC motor can drive annular running belt mentioned above during operating. Comparing with existing technology, advantages of this invention lie in: 1. The design is more reasonable, the (Continued)

Figure 1:
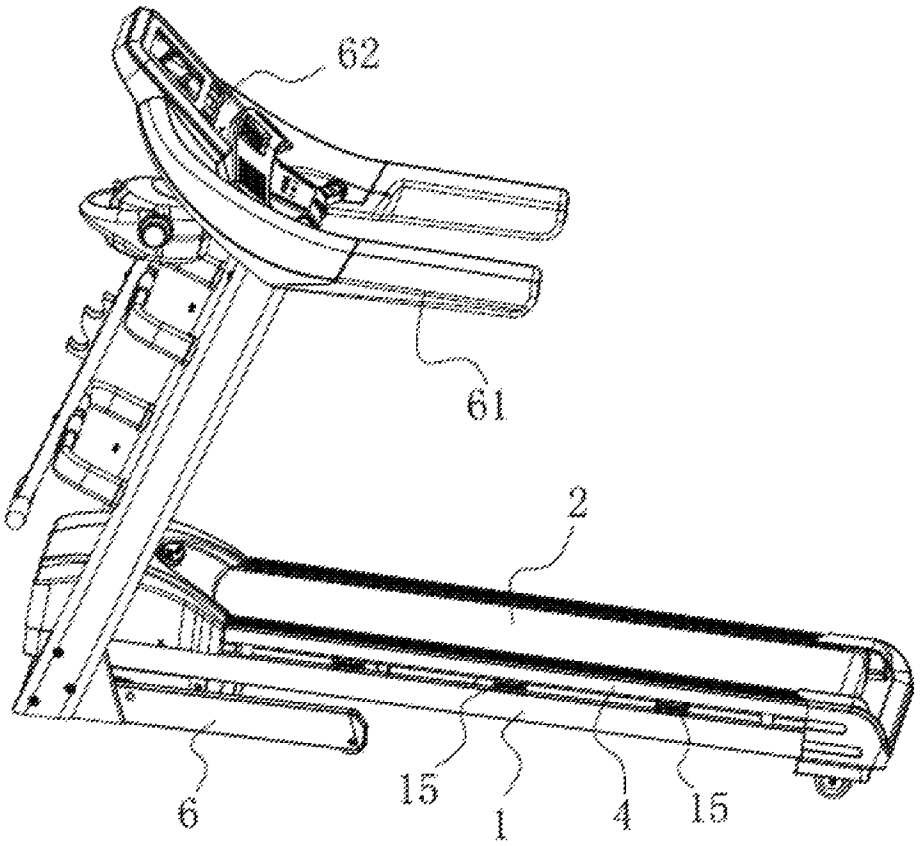

machine is equipped with outer rotor brushless DC motor, which can produce inertia force during rotating, such inertia force can ensure operation stability of the treadmill, secondly, it can also improve the operation efficiency, in addition, the brushless slice can also reduce operation noise of the treadmill, with strong availability. 2. The costs are low.

11 Claims, 5 Drawing Sheets

(56) References Cited

U.S. PATENT DOCUMENTS 6,302,826 B1 * 10/2001 Lee ..... A63B 22/02 482/51
6,455,960 B1 * 9/2002 Trago ..... H02K 7/1016 310/64
6,661,136 B1 * 12/2003 Lee ..... H02K 5/00 310/74
6,765,329 B2 * 7/2004 Wolters ..... H02K 1/146 310/51
6,833,644 B1 * 12/2004 Lee ..... H02K 23/62 310/91
6,879,078 B2 * 4/2005 Wolters ..... H02K 1/146 310/216.074
7,337,524 B2 * 3/2008 Wolters ..... H02K 1/146 29/596
7,362,016 B2 * 4/2008 Cheng ..... A63B 22/02 310/52
9,937,375 B2 * 4/2018 Zhu ..... A63B 22/02
2002/0107113 A1 * 8/2002 Mosley ..... A63B 22/02 482/54
2003/0094867 A1 * 5/2003 Wolters ..... H02K 1/146 310/64
2005/0209060 A1 * 9/2005 Lull ..... A63B 22/0235 482/54
2005/0233864 A1 * 10/2005 Smith ..... A63B 22/0056 482/52
2013/0035214 A1 * 2/2013 Wang ..... A63B 22/02 482/54
2017/0305676 A1 * 10/2017 Ramezani ..... B65G 13/06
2018/0056119 A1 * 3/2018 Zhu ..... A63B 22/0207

FOREIGN PATENT DOCUMENTS

CN 203954551 11/2014
CN 104707296 6/2015
CN 204582410 8/2015

OTHER PUBLICATIONS

First Office Action, issued in the corresponding Chinese application No. CN201510075120.2, dated Jul. 6, 2016, 7 pages.
Notification to Grant Patent Right for Invention, issued in the corresponding Chinese application No. CN201510075120.2, dated Aug. 2, 2016, 3 pages.

* cited by examiner

LOW ENERGY CONSUMPTION, HIGH EFFICIENCY TREADMILL

TECHNICAL FIELD

This invention involves in technical field of the treadmill, especially, it involves in a kind of low-energy consumption high-efficient treadmill.

TECHNICAL BACKGROUND

The treadmill is equipment commonly used in the family and gym, and it is the simplest among fitness equipment in current families, which is the most selection of family fitness equipment. Instructions for the treadmill: A pivoted arm is installed at proper position on the arm-rest frame and then extend the pivoted arm to front downward, the other end installed at proper position of the running frame, a pulley affixing to the ground is installed at bottom of the running frame's front end, this pulley will help the user to apply force, and this unit is easy to contract and firmly support. At present, in general, the driving mode of existing treadmill's running belt: The brush motor drives the structure connected to the roller with the belt. This structure can meet the using requirements at some extent, but such scheme has the following defects at least: The design is unreasonable, brush slice of the brush motor is easy to wear and the noise is large, in addition, the inertia wheel shall also be set to reduce operation energy-consumption of the treadmill and improve the stability, so that the costs are high. In order to solve existing technical issues, long-term exploration has been conducted, and various solutions have been improved.

For example, Chinese patent literature published a kind of treadmill [Application No.: 201420026381.6], it includes a base, both ends of the base are respectively set with the beginning roller and tail roller, the running belt is installed to wind the beginning roller and tail roller, The end near the beginning roller on the base is set with two vertical supporting arms, an inverted U-shape support is installed on the supporting arm by sliding, the support is installed with two vertical uprights and one horizontal beam, the upright is installed on the supporting arm by sliding, a locking structure is installed between it and the supporting arm, the beam is equipped with a display screen, and the support is oppositely equipped with two handrails extended horizontally, the both handrails extend from the beginning roller to tail roller, and one handrail is equipped with a gauge for measuring the exerciser's blood pressure and heart rate, the gauge is connected to the display screen. This scheme can timely display the user's physical situation for making corresponding adjustment, and this equipment is widely used for physical fitness.

The scheme above can solve existing some technical issues at some extent, but this scheme has the following defects at least: The design is unreasonable, the scheme can't solve technical issues above, and the availability is poor.

CONTENTS OF THE INVENTION

For solving the issues above, this invention provides a kind of low-energy consumption high-efficient treadmill with more reasonable design, the machine can reduce operation energy consumption, and the noise is small.

For meeting the purpose above, this invention adopts the following technical scheme: The low consumption treadmill is equipped with the treadmill rack, and the treadmill rack is installed with annular running belt, one end of the treadmill rack is equipped with the rotation roller, and the other end is equipped with the outer rotor brushless DC motor, the rotation roller mentioned above are arranged with the outer rotor brushless DC motor in parallel, the annular running belt mentioned above is winded between rotation roller and outer rotor brushless DC motor, and outer rotor brushless DC motor can drive annular running belt mentioned above during operating.

In this application, the outer rotor brushless DC motor set can inertia force during operating, and such force can ensure stable operation of the treadmill, secondly, it can improve the operation efficiency, in addition, the brushless slice can also reduce operating noise of the treadmill, with strong availability.

In the low-energy consumption high-efficient treadmill mentioned above, the outer rotor brushless DC motor includes outer rotor and inner stator, the inner stator mentioned is firmly connected to the treadmill rack, and the annular running belt mentioned above is winded on periphery of the outer rotor.

In the low-energy consumption high-efficient treadmill mentioned above, periphery of outer rotor mentioned is sheathed with tubular body fixedly connecting to outer rotor in circumference, and annular running belt mentioned is winded on periphery of tubular body.

In the low-energy consumption high-efficient treadmill mentioned above, length of tubular body shall be not less than width of annular running belt.

In the low-energy consumption high-efficient treadmill mentioned above, the running-belt plate fixed on treadmill rack is installed between rotation roller and outer rotor brushless DC motor, the annular running belt is located on periphery of the running belt plate.

In the low-energy consumption high-efficient treadmill mentioned above, front end of treadmill rack mentioned is suspended on chassis through suspension structure, and when treadmill rack accepts an acting force downward, so that front end of treadmill rack moves downward, suspension structure mentioned can help front end of treadmill rack to move upward for restoring original position.

In the low-energy consumption high-efficient treadmill mentioned above, suspension structure mentioned includes one cantilever at least, and one end of cantilever mentioned is hinged on treadmill rack, the other end is connected to the chassis through an elastic component, and middle of cantilever mentioned is hinged on the chassis.

In the low-energy consumption high-efficient treadmill mentioned above, suspension structure mentioned has two sets of suspension structures, and the both are arranged on both sides of treadmill rack symmetrically.

In the low-energy consumption high-efficient treadmill mentioned above, the elastic component mentioned includes a conducting rod, while, one end of the conducting rod mentioned is hinged with the cantilever, the other end passes through the chassis, and an elastic block that can be against on chassis is fixed at this end.

In the low-energy consumption high-efficient treadmill mentioned above, the Cantilever mentioned is L-shaped, and corner part of the cantilever is hinged on the chassis, and the length of one end of cantilever connected to the treadmill rack is larger than that of the end connected to the elastic component.

In the low-noise direct-driving treadmill mentioned above, the treadmill rack mentioned includes a framework, front and lower part of the framework is fixed with a cantilever support, and the cantilever mentioned is hinged at front end of the cantilever support, a damping cylinder is installed between the chassis and middle part of the treadmill rack, one end of the damping cylinder mentioned is firmly connected to the chassis, and the other end is firmly connected to the treadmill rack.

In the low-noise direct-driving treadmill mentioned above, an elastic buffer structure is installed between the running belt plate and the framework; the elastic buffer structure includes several buffer parts which are respectively installed both sides of the framework and between the framework and running belt plate, and the elastic buffer parts mentioned shall be set with one-by-one correspondence. The elastic buffer structure can improve damping capacity for rear end of the treadmill, so that various parts of the treadmill have damping performance. The elastic buffer parts are respectively and uniformly set on both sides of the framework with one-by-one correspondence.

In the low-noise direct-driving treadmill mentioned above, the elastic buffer parts include the first strip-type pressing plate and the second pressuring plate set up and down in correspondence, the first strip-type pressuring plate mentioned is connected to side edge of the running belt plate, and the second strip-type pressing plate mentioned is fixed on side edge of the framework, and several buffer springs are set between the first strip-type pressing plate and the second pressuring plate mentioned. When the running plate accepts an acting force downward, the buffer springs can provide counter-acting force upward to get buffer and shock absorption effect.

Comparing with existing technologies, the low-energy consumption high-efficient treadmill has the following advantages: 1. The design is more reasonable, the machine is designed with outer rotor brushless DC motor, which can produce inertia force during rotating, such inertia force can ensure operation stability of the treadmill, secondly, it can also improve the operation efficiency, in addition, the brushless slice can also reduce operation noise of the treadmill, with strong availability. 2. The structure is simple, easy to manufacture, and the service life is long. 3. The damping effect is good.

INSTRUCTIONS FOR THE ATTACHED PICTURES

FIG. 1: Structure Diagram Provided by this Invention

Figure 2:
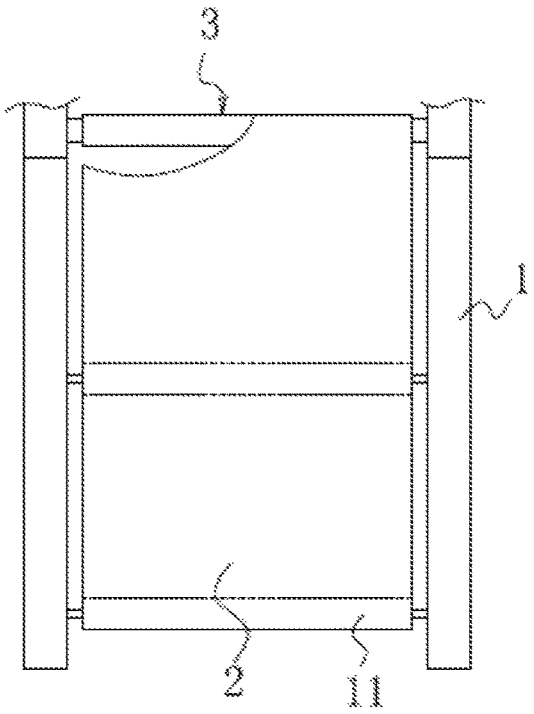
Figure 3:
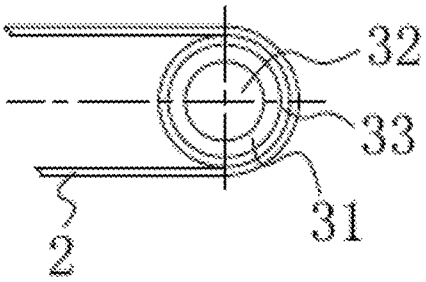
Figure 4:
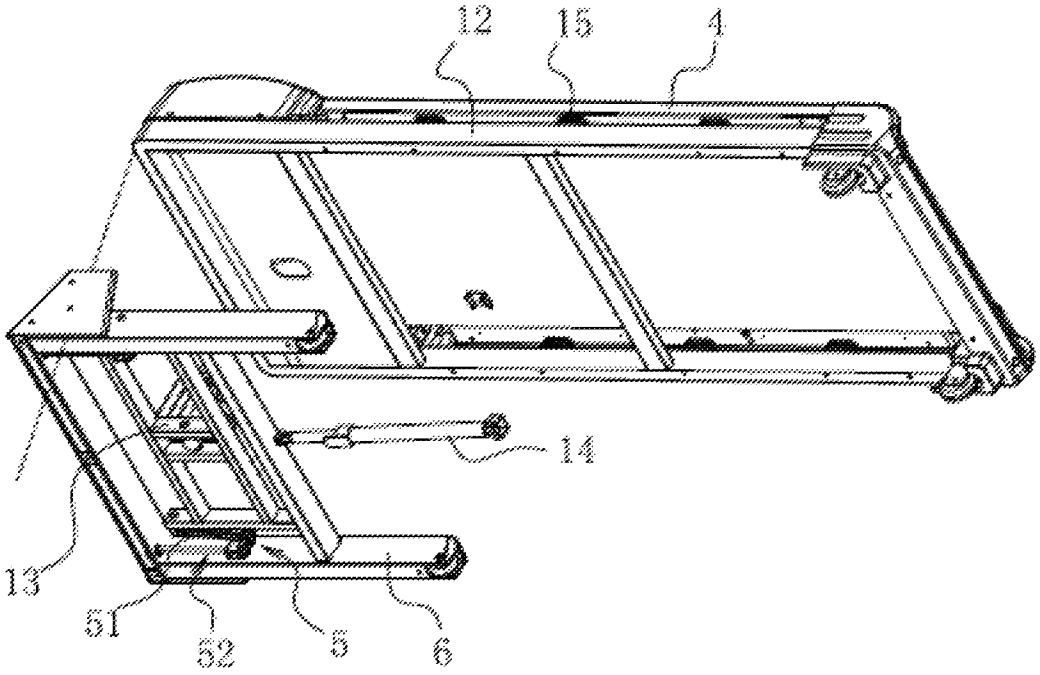
Figure 5:
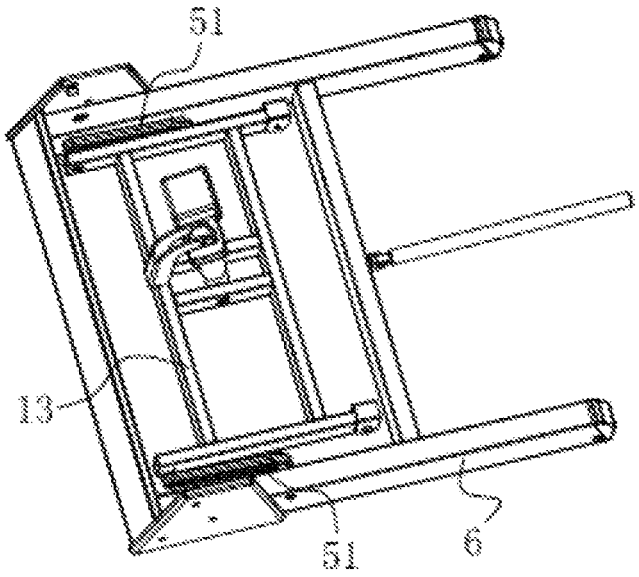

FIG. 2: Simplified Structural Diagram of the Treadmill Provided by This Invention FIG. 3: The Structural Diagram that Outer-Rotor Tubular Motor is Connected to the Annular Running Belt Provided by this Invention FIG. 4: The Explosion Structure Diagram after the Handrail being Removed Provided by this Invention FIG. 5: Partial Structural Diagram of FIG. 4

Figure 6:
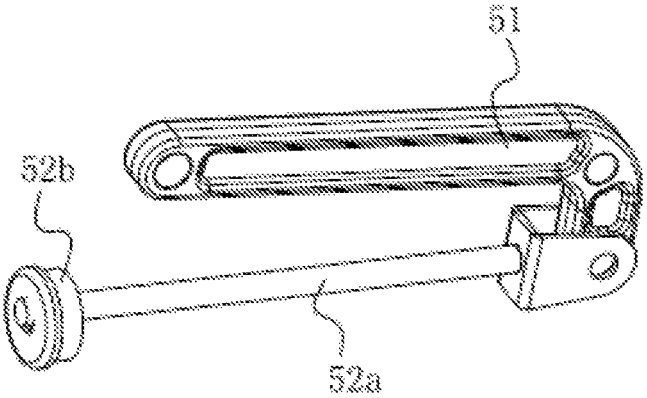

FIG. 6: The Suspension Structure Diagram Provided by this Invention

Figure 7:
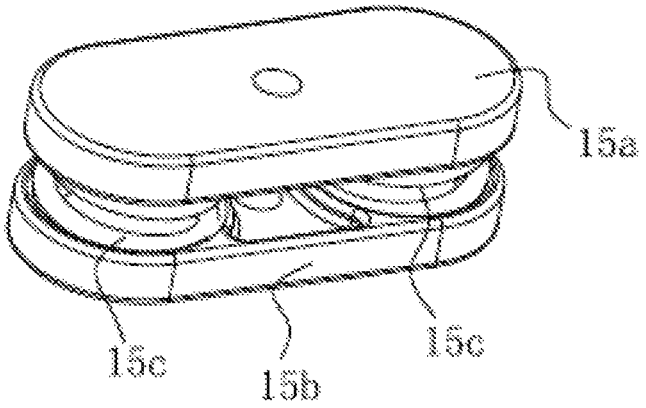

FIG. 7: Structural Diagram for Elastic Buffer Parts Provided by this Invention The Figures include: Treadmill rack 1, rotation roller 11, framework 12, cantilever support 13, damping cylinder 14, buffer parts 15, the first strip-type pressing plate 15*a*, the second pressuring plate 15*b*, buffer spring 15*c*, annular running belt 2, outer rotor brushless DC motor 3, outer rotor 31, inner stator 32, tubular body 33, running belt plat 4, suspension structure 5, cantilever 51, elastic component 52, conducting rod 52*a*, elastic block 52*b*, and chassis 6.

SPECIFIC IMPLEMENTATION MODE

The following are specific implement examples, combining with attached figures to further describe technical scheme of this invention, but this invention is not limited to such implementation examples.

As shown in FIGS. 1-7, the low-energy consumption high-efficient treadmill includes treadmill rack 1, annular running belt 2 is installed on treadmill rack 1, one end of treadmill rack 1 is set with rotation roller 11, and the other end is set with outer rotor brushless DC motor 3, the rotation roller 11 mentioned above are arranged with the outer rotor brushless DC motor 3 in parallel, annular running belt 2 mentioned above is winded between rotation roller 11 and outer rotor brushless DC motor 3, and outer rotor brushless DC motor 3 can drive annular running belt 2 mentioned above during operating. outer rotor brushless DC motor can produce inertia force during rotating, such inertia force can ensure operation stability of the treadmill, secondly, it can also improve the operation efficiency, in addition, the brushless slice can also reduce operation noise of the treadmill, with strong availability.

Specifically, in this implementation example, outer rotor brushless DC motor 3 includes outer rotor 31 and inner stator 32, and the inner stator 32 mentioned is firmly connected to treadmill rack 1, while the annular running belt 2 mentioned above is winded on periphery of outer rotor 31.

Prioritization scheme: The outer rotor 31 is sheathed with tubular body 33, which is firmly connected to outer rotor 31 in circumference, the annular running belt 2 mentioned is winded on periphery of tubular body 33. And length of tubular body 33 shall be not less than width of annular running belt 2.

In addition, running belt plate 4 fixed on treadmill rack 1 is installed between rotation roller 11 and outer rotor brushless DC motor 3, and the annular running belt 2 is located on periphery of running belt plate 4. Secondly, in this implementation example, front end of treadmill rack 1 is suspended on chassis 6 through suspension structure 5, and when treadmill rack 1 accepts an acting force downward, so that front end of treadmill rack 1 moves downward, suspension structure 5 mentioned can help front end of treadmill rack 1 to move upward for restoring original position.

Specifically, the suspension structure 5 here includes one cantilever 51 at least, and one end of cantilever 51 mentioned is hinged on treadmill rack 1, the other end is connected to the chassis 6 through an elastic component 52, and middle of cantilever 51 mentioned is hinged on the chassis 6. the elastic component 52 mentioned includes a conducting rod 52*a*, while, one end of the conducting rod 52*a* mentioned is hinged with the cantilever 51, the other end passes through the chassis 6, and an elastic block 52*b* that can be against on chassis 6 is fixed at this end. Secondly, cantilever 51 is L-shaped, and corner part of the cantilever 51 is hinged on the chassis 6, and the length of one end of cantilever 51 connected to the treadmill rack 1 is larger than that of the end connected to the elastic component 52. The chassis 6 is equipped with handrail 61 and instrument panel 62.

As the most optimized scheme in this implementation example, there are two sets of suspension structure 5 in this implementation example, which are symmetrically set on both sides of treadmill rack 1.

The treadmill rack in this implementation example include framework 12, the cantilever support 13 is fixed in the front, and lower of framework 12, the cantilever mentioned is hinged at front end of cantilever support 13, the damping cylinder 14 is installed between the chassis and middle of the treadmill rack mentioned, one end of damping cylinder 14 mentioned is firmly connected to the chassis, and the other end is firmly connected to the treadmill rack.

Secondly, an elastic structure is set between the running belt plate and framework 12; the elastic buffer structure includes several buffer parts which are respectively installed both sides of the framework 12 and between the framework 12 and running belt plate, and the elastic buffer parts 15 mentioned shall be set with one-by-one correspondence. The elastic buffer structure can improve damping capacity for rear end of the treadmill, so that various parts of the treadmill have damping performance. Elastic buffer parts 15 are respectively and uniformly set on both sides of the framework 12 with one-by-one correspondence.

In addition, elastic buffer parts 15 include the first strip-type pressing plate 15*a*, and the second pressuring plate 15*b*, which are arranged in correspondence up and down, the first strip-type pressuring plate 15*a* mentioned is connected to side edge of the running belt plate, and the second strip-type pressing plate 15*b* mentioned is fixed on side edge of the framework 12, and several buffer springs 15*c* are set between the first strip-type pressing plate 15*a* and the second pressuring plate 15*b* mentioned. When the running plate accepts an acting force downward, the buffer springs can provide counter-acting force upward to get buffer and shock absorption effect.

Specific implementation examples described in this paper is only the illustration of the invention spirits. The technician in the field of this invention can make various modifications or supplements to the specific example described or take similar means to substitute, but this shall not deviate with spirits of this invention or exceed the range defined by the patent Claims.

Although, many terms (such as treadmill rack 1 rotation roller 11, framework 12, cantilever support 13, damping cylinder 14, buffer parts 15, the first strip-type pressing plate 15*a*, the second pressuring plate 15*b*, buffer spring 15*c*, annular running belt 2, outer rotor brushless DC motor 3, outer rotor 31, inner stator 32, tubular body 33, running belt plat 4, suspension structure 5, cantilever 51, elastic component 52, conducting rod 52*a*, elastic block 52*b*, and chassis 6.) are used frequently in this paper, but this not eliminate the possibility of using other terms. Use of such terms is only for easily describing and explaining nature of this invention; any explanation about them as a kind of additional limit is violation to spirits of this invention.

The invention claimed is:

1. A treadmill comprising:
a rack;
an annular running belt;
a rotation roller; and
a brushless DC motor having an outer rotor and an inner stator, the outer rotor wrapping around the inner stator,
wherein the annular running belt is mounted on the rack,
the rotation roller is disposed at a first end of the rack,
the brushless DC motor is disposed at a second end of the rack in parallel with the rotation roller,
the annular running belt is wound on a periphery of the rotation roller,
the outer rotor of the brushless DC motor is configured to drive the annular running belt,
the inner stator of the brushless DC motor connects to the rack,
a perimeter of the outer rotor of the brushless DC motor is wrapped by a tubular body,
the tubular body is fixedly connected to the perimeter of the outer rotor of the brushless DC motor, and
the annular running belt is wound on a periphery of the tubular body.

2. The treadmill according to claim 1, wherein a length of the tubular body is not less than a width of the annular running belt.

3. The treadmill according to claim 1, further comprising:
a running-belt plate,
wherein the running-belt plate is fixed on the rack,
the running-belt plate is disposed between the rotation roller and the outer rotor of the brushless DC motor, and
the annular running belt is located on a periphery of the running belt plate.

4. A treadmill comprising:
a rack;
an annular running belt;
a rotation roller;
a brushless DC motor having an outer rotor and an inner stator, the outer rotor wrapping around the inner stator;
a chassis; and
a suspension structure for absorbing shock,
wherein the annular running belt is mounted on the rack,
the rotation roller is disposed at a first end of the rack,
the brushless DC motor is disposed at a second end of the rack in parallel with the rotation roller,
the annular running belt is wound on a periphery of the rotation roller and a periphery of the outer rotor of the brushless DC motor,
the outer rotor of the brushless DC motor is configured to drive the annular running belt,
the inner stator of the brushless DC motor connects to the rack,
a front end of the rack is suspended on the chassis through the suspension structure, and
when a force pushes the rack downwards so that the front end of the rack moves downwards, the suspension structure is configured to move the front end of the rack upwards to restore the front end of the rack to an original position.

5. The treadmill according to claim 4, wherein the suspension structure includes a cantilever,
a first end of the cantilever is hinged on the rack,
a second end of the cantilever is connected to the chassis through an elastic component, and
a middle of the cantilever is hinged on the chassis.

6. The treadmill according to claim 5, wherein the treadmill includes two sets of suspension structures, and
the two sets of the suspension structures are symmetrically disposed on both sides of the rack.

7. The treadmill according to claim 6, wherein the elastic component includes a conducting rod,
a first end of the conducting rod is hinged on the cantilever,
a second end of the conducting rod passes through the chassis, and
an elastic block against the chassis is fixed at the second end of the conducting rod.

8. The treadmill according to claim 7, wherein the cantilever is L-shaped having a first part and a second part,
a corner part of the cantilever is hinged on the chassis,
a length of the first part of the cantilever connected to the rack is larger than a length of the second part of the cantilever connected to the elastic component.

9. The treadmill according to claim 5, wherein the rack includes a framework,
a cantilever support is fixed below a front portion of the framework,
the cantilever is hinged on a front end of the cantilever support, a damping cylinder is disposed between the chassis and a middle of the rack, a first end of the damping cylinder is connected to the chassis, and a second end of the damping cylinder is connected to the rack.

10. The treadmill according to claim 9, further comprising:

an elastic buffer structure, wherein the elastic buffer structure is disposed between the running belt plate and the framework, the elastic buffer structure includes elastic buffer parts, the elastic buffer parts are symmetrically disposed on both sides of the framework, and the elastic buffer parts are disposed between the framework and the running belt plate.

11. The treadmill according to claim 10, wherein each of the elastic buffer parts includes a first pressing plate, a second pressuring plate, and buffer springs sandwiched between the first pressing plate and the second pressuring plate, the first pressuring plate is connected to a side edge of the running belt plate, the second pressing plate is fixed on a side edge of the framework, and when a force pushes the running plate downwards, the buffer springs are configured to provide an upward counter force.

* * * * *